US005167712A

United States Patent [19]

Shibata et al.

[11] Patent Number: 5,167,712

[45] Date of Patent: Dec. 1, 1992

[54] DEVICE FOR APPLYING A LIQUID TO A FLEXIBLE CARRIER

[75] Inventors: Norio Shibata; Akihiro Suzuki, both of Kanagawa, Japan

[73] Assignee: Fuji Photo Film Co., Ltd., Kanagawa, Japan

[21] Appl. No.: 683,166

[22] Filed: Apr. 10, 1991

[30] Foreign Application Priority Data

Apr. 12, 1990 [JP] Japan ..... 2-95059

[51] Int. Cl.[5] ..... B05C 5/02

[52] U.S. Cl. ..... 118/410; 118/419; 427/356

[58] Field of Search ..... 118/410, 419, 415; 427/356, 357, 358

[56] References Cited

U.S. PATENT DOCUMENTS 4,299,186 11/1981 Pipkin et al. ..... 118/410

4,424,762 1/1984 Tanaka et al. ..... 118/410

*Primary Examiner*—Michael G. Wityshyn

*Attorney, Agent, or Firm*—Sughrue, Mion, Zinn, Macpeak & Seas

[57] ABSTRACT

An application device for applying a liquid, such as a photographic photosensitive liquid, to the surface of a flexible carrier that is continuously moving on path rollers, while an outlet portion of a slot of an extrusion-type application head is pushed toward the surface of the flexible carrier. The application head has an outlet portion including two end portions having an intermediate portion therebetween, with the top surface of the intermediate portion horizontally lying below top surfaces of the end portions. As the carrier passes over the outlet portion, a gap between the side edge portions of the carrier and the surfaces of the end portions is less than the width of the gap between the central portion of the carrier and the surface of the intermediate portion. Further, first and second wall surfaces vertically extend up from the surface of the intermediate portion to couple respective surfaces of the end portions so that the solvent applied to the side edge portions of the carrier is prevented from being spread to the central portion of the carrier as the carrier moves past the application head. The application device prevents a solvent, which is applied in advance to side edge portions of the carrier, from spreading into the central portion of the carrier where the liquid is to be applied.

6 Claims, 2 Drawing Sheets

DEVICE FOR APPLYING A LIQUID TO A FLEXIBLE CARRIER

BACKGROUND OF THE INVENTION

The present invention relates to a device for applying a liquid, such as a photographic photosensitive liquid, a magnetic liquid, or a surface protective liquid to a flexible carrier (also referred to herein as a web) such as a plastic film, paper, or foil.

Conventional application devices for applying a liquid to a web are well known and generally are, for example, of the roller type, bead type, slide coating type, or extrusion type. The width of each of the devices is wider than the width of the web. The width of the web can be divided into three portions. That is, the width of the web includes one central portion having a predetermined width and two edge portions having a predetermined width approximately in the range of a few to several millimeters. The liquid is applied to the central portion (i.e., liquid-applied portion) but is not applied to the edge portions (i.e., liquid-free portions).

In the extrusion-type device where the liquid is applied to the web while the application head is pushed toward the moving web, as described in the Unexamined Japanese Patent Applications Nos. 84771/82 and 94657/84, the head comes into contact with both side edge portions of the web because the gap between the head and the web is very small. As a result, the application head scrapes the surfaces of the side edge portions of the web causing scraped chips to cling to the end parts of the application edge portion of the head. In addition, foreign matter tends to cling to the surface of the web and become caught on the end parts of the application edge portion of the head. Because the scraped chips and the foreign matter accumulate on the end parts of the application edge portion of the head, the web is pushed up at both side edge portions, and therefore the thickness of the liquid applied to the web is not uniform along the width of the web. In other words, the liquid is not evenly applied, and the thickness of the applied liquid is greater near the side edge portions of the web than the central portion. This is a problem.

To solve this problem, the following application method and device have been proposed. In the proposed method, a solvent is applied to both the liquid-free side edge portions of the web immediately before a liquid is applied to the liquid-applied central portion of the web. Such a method is disclosed in Japanese Unexamined Patent Application No. 257268/86. In the proposed device, the surfaces of both end parts of the application edge portion of the application head, which correspond to the liquid-free side edge portions of the web, slope downward from the surface of the intermediate part of the application edge portion, or they are made smaller in height than the surface of the intermediate part. Thus, a gap is defined between the surface of the liquid-free side edge portions of the web and the surface of the end part of the application edge portion of the head. Such a structure is disclosed in Japanese Patent Application No. 52069/90. However, in this method, the solvent is likely to enter the surface of the liquid-applied portion of the web and/or flow around to the opposite surface of the web due to disturbance such as fluctuations or meandering of the web while it moves along the path rollers, making the thickness of the applied liquid on the web nonuniform. This too is a problem. The width of the solvent applied to each liquid-free side edge portion of the web is increased by the application edge portions (i.e., the back edge portion and doctor edge portion) of the application head. It is difficult to adequately control the width of the applied solvent on the liquid-free side edge portion of the web if the width Of the liquid-free portion is small or the amount of scraping of the doctor edge portion of the application head is high. This also is a problem.

If the solvent enters the surface of the liquid-applied portion of the web or flows around to the opposite surface of the web, for instance during the manufacturing of a magnetic recording medium, a subsequently applied magnetic liquid will unavoidably be caused to cling to a conveyance roller driving the nonmagnetic carrier, as a result of which the liquid contaminates the carrier and a calendering roller used for processing the surface of the carrier after the application of the liquid to the carrier. This causes a problem in that the surface of the carrier is flawed or scratched due to the foreign matter and the like, thereby deteriorating the magnetic recording properties of the medium. Moreover, if the web is a flexible carrier having a small thickness of approximately 15 to 40 μm, the rigidity of the web is so low that the web sags greatly at both side edges toward the application edge portions of the application head. This results in a problem that the side edges of the web come into contact with the edges of the sloped or height-reduced surfaces of the end parts of the application edge portions of the head so as to be cut or scraped.

Recently, the web of a magnetic recording medium for video use has been made of a polyethylene terephthalate base to which spherical grains Of $SiO_2$ are added as a filler to reduce the amount of friction between the medium and the contact portion of the guide posts of a magnetic recording/playback machine to thus stabilize the running of the medium in the machine. However, the rigidity of the polyethylene terephthalate base containing the filler is so low that the web is likely to sag greatly at both side edges thereof toward the application edge portion of the application head when a liquid is applied to the web. Furthermore, when the web comes into contact with the application edge portion of the head, the filler is likely to come off the web so that a large quantity of scraped dust accumulates on the application edge portion. This too is a problem.

To solve the foregoing problems of the above-described methods and devices, another application device has been proposed in Japanese Patent Application No. 320546/88. In this device, both end parts of the application edge portion of the application head, which correspond to the liquid-free side edge portions of a web, are provided with notches extending in the direction of the movement of the web, and shoulders of the end parts of the application edge portion, which define the notches, provide support for the web at the side edges thereof. Because of the structure of this application device, even if the thickness of the web is small, the liquid-free portions of the web are not scraped by the application edge portions of the application head near the liquid-applied portion of the web and no foreign matter clinging to the surface of the web is caught on the head at the ends thereof.

However, in an application device in which the end parts of the application edge portion of the application head have notches and shoulders as just described, the liquid-free side edge portions of the web need support to prevent them from rubbing against the end parts of the application edge portion of the head, at least near the liquid-applied portion of the web. As a result, the width of each of the notches and the height of each of the shoulders are determined in terms of the thickness of the web. Therefore, it is necessary to adjust the application head every time the thickness or quality of the web is changed. This causes another problem in that the efficiency of production using the device is reduced.

SUMMARY OF THE INVENTION

It is therefore a general object of the present invention to solve the foregoing problems.

In accordance with the above and other objects, the invention provides an application device for applying a liquid to a web in such a manner that the thickness of the liquid applied to the web is uniform, the surface of the layer is made satisfactory, even if the thickness of the web is small, and the applied liquid is unlikely to flow out of the liquid-applied portion of the carrier.

The application device provided in accordance with the present invention is employed for applying a liquid to the surface of a flexible band-like carrier, which is continuously moving on path rollers, while pushing an outlet portion of the slot of an extrusion-type application head toward the surface of the carrier. The device is characterized in that the surfaces of both end parts of the outlet section of the back edge portion of the application head, which correspond to the liquid-free side edge portions of the carrier, and the surface of the intermediate part of the outlet section of the back edge portion, which corresponds to the liquid-applied portion of the carrier, are coupled to each other by wall surfaces extending upward from the surface of the intermediate part to the surfaces of the end parts. Thus, a solvent applied to both of the liquid-free side edge portions of the carrier is prevented from spreading to the liquid-applied portion of the carrier.

The above and other objects, features and advantages of the present invention will become more apparent from the following detailed description taken in conjunction with the accompanying drawings.

DESCRIPTION OF THE PREFERRED EMBODIMENTS

Figure 1:
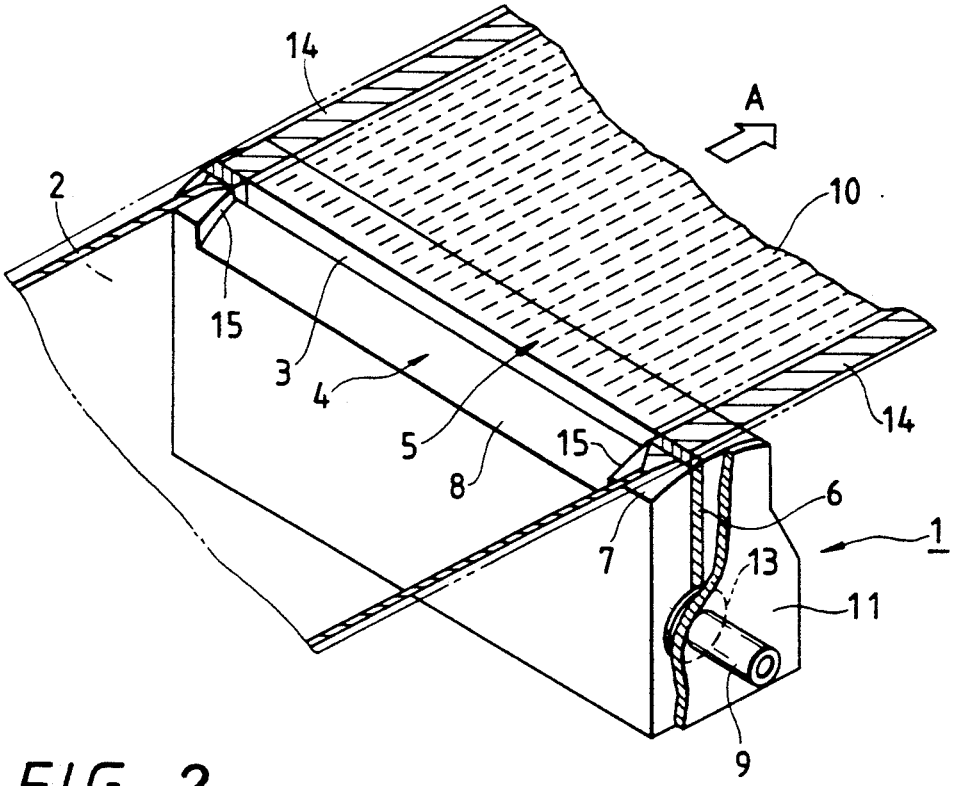
FIG. 1 is a perspective view of an extrusion-type application head of an application device embodying this invention.
Figure 2:
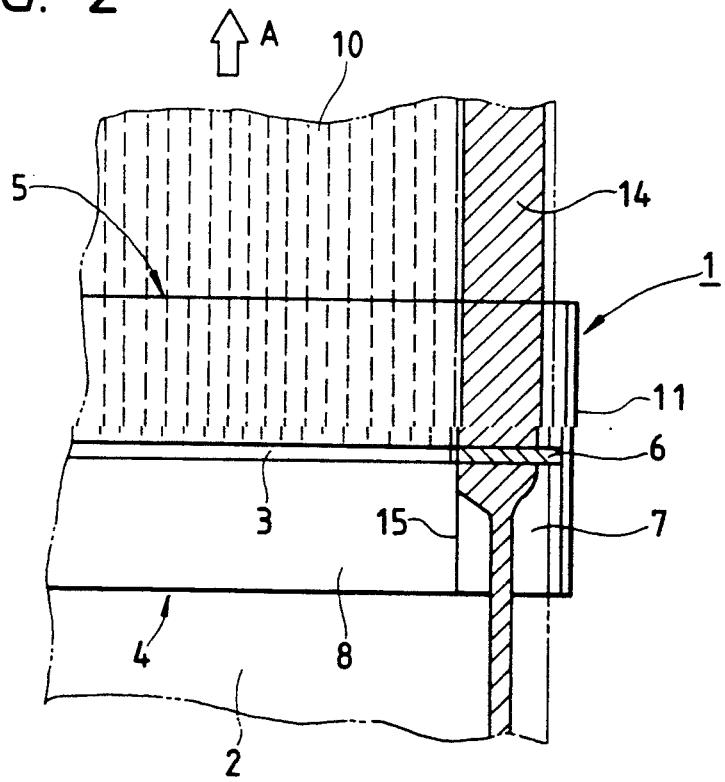
FIG. 2 is a partial sectional view of the head of the device of FIG. 1.

Shown in the drawings are extrusion-type application heads 1 and 16, a web 2, a slot 3, a back edge portion 4, a doctor edge portion 5, a restriction plate 6, the surface 7 of the end part of the outlet section of the back edge portion, a notch 8, a liquid feed port 9, a layer 10 of an applied liquid, a side plate 11, a liquid reservoir 13, a solvent 14, a wall surface 15, and a groove 17.

FIG. 1 is a perspective view of an extrusion-type application head 1 of an application device embodying this invention. The width of the application head 1 is wider than the width of the web 2 (i.e., a flexible carrier). The head 1 includes a back edge portion 4 and a doctor edge portion 5 between which is defined a slot 3, which extends along the width of the web 2 and from which a liquid is applied to the web. The slot 3 communicates with a liquid reservoir 13 provided in the head 1. The liquid supplied through a liquid feed port 9 provided in a side plate 11 at one end of the liquid reservoir 13 is discharged from the slot 3, under uniform pressure along the width of the slot. Restriction plates 6 are fitted in the slot 3 at both ends thereof to set the width of the liquid-applied portion of the web 2 and so that the liquid is not applied to the side edge portions of the web (herein referred to as liquid-free portions).

The intermediate part of the outlet section of the back edge portion 4, which corresponds to the liquid-applied portion of the web 2, has a notch 8 extending between wall surfaces 15 adjacent to the surfaces 7 of the end parts of the outlet section of the back edge portion, so that a gap is defined between the intermediate part of the outlet section and the web. A solvent 14, such as butyl acetate or methyl ethyl ketone, is applied to the liquid-free side edge portions of the web 2 in advance. The liquid is thereafter applied to the liquid-applied portion of the moving web 2, while the outlet portion of the slot 3 of the application head 1 is pushed toward the surface of the web, so that a layer 10 of the liquid is uniformly applied to the liquid-applied portion of the web.

The width of the layer of the applied solvent 14 applied in advance to each liquid-free side edge portions of the web 2 is much smaller than is the same layer of solvent after it reaches and passes through the application head 1. That is, the layer of the applied solvent is pushed and spread by the surfaces of the end parts of the outlet section of the back edge portion 4, as shown in FIG. 1, as the web moves across the application head. The contact surfaces of the side edge portions of the web and those of the outlet section of the head 1 are lubricated by the solvent.

In general, it is difficult to adequately control the width of the layer of the solvent 14 applied to each liquid-free side edge portion of the web 2 in advance because the width of the layer of the applied solvent 14 is likely to change due to disturbances such as the fluctuations or meandering of the web 2 during its movement. Typically, in conventional application devices, the surface of the intermediate part of the outlet section of the back edge portion of the application head is flush with those of the end parts of the outlet section so that a gap between the surface of the intermediate part and the web is the same as the gap between the surface of each of the end parts and the web. As a result, if the width of the layer of a solvent applied to the web changes, the solvent also spreads to the liquid-applied portion of the web interfering with the application of the liquid.

In contrast to the conventional application device, the application device of the present invention has a notch 8 in the intermediate part of the outlet section of the back edge portion 4 of the application head 1 between the wall surfaces 15. Therefore, the gap between the surface of the intermediate part and the web is larger than the gap between each end part of the outlet section and the surface of the web 2. For this reason, although the solvent 14 is pushed and spread by the surfaces 7 of the end parts of the outlet section of the back edge portion 4 of the head 1, the solvent is unlikely to be spread inward from the wall surfaces 15 in the direction of the width of the web 2 (i.e., into the liquid-applied portion). The applied portion of the solvent 14 can thus be set further from the side edges of the web 2 to control the width of the layer of the applied solvent on each side edge portion of the web because the solvent is prevented from spreading to the liquid-applied portion of the web and making the application of the liquid to the web nonuniform. The solvent is also prevented from flowing around to the opposite surface of the web. In sum, the solvent 14 can be applied to the liquid-free side edge portions of the web 2 in advance so that it does not spread to the liquid-applied portion of the web or flow around to the opposite surface thereof. Moreover, the solvent 14 applied to the liquid-free side edge portions is prevented from coming into contact with the outlet section of the application head 1. As a result, the liquid-free side edge portions of the web 2 are not scraped by the outlet section of the head 1 and foreign matter clinging to the surface of the web is not caught on the head at the ends of the back edge portion 4 and doctor edge portion 5 of the application head. Therefore, foreign matter is prevented from accumulating on the head 1 at both ends thereof and causing the web 2 to be pushed up at the side edges thereof, and thus the thickness of the layer of the applied liquid on the web along the width of the web is uniformly applied.

Figure 3:
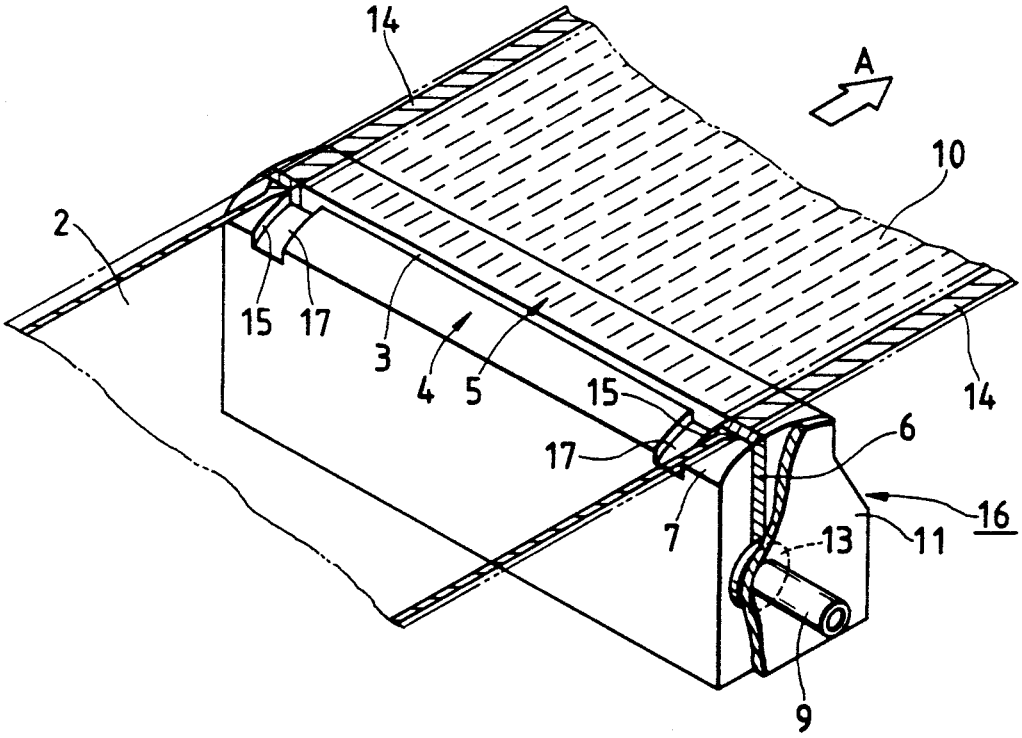
FIG. 3 is a perspective view of an extrusion-type application head of an application device according to another embodiment of this invention.

FIG. 3 shows an extrusion-type application head 16 of an application device in accordance with another embodiment. The head 16 includes a back edge portion 4, a doctor edge portion 5 and restriction plates 6 similar to the application head 1 of the preceding embodiment. The intermediate part of the outlet section of the back edge portion 4 of the head 16, which corresponds to the liquid-applied portion of the web 2, has grooves 17 adjacent to the surfaces 7 of the end parts of the outlet section of the back edge portion, corresponding to the liquid-free side edge portions of the web. Each of the grooves 17, which extend in the direction of the movement of the web 2, has a rectangular cross section, and is located on the wall surface 15 at the surfaces 7 of the end parts of the outlet section of the back edge portion 4. The solvent 14, such as butyl acetate or methyl ethyl ketone, is applied to the liquid-free side edge portions of the web 2 in advance as previously described. A liquid is applied to the liquid-applied portion of the moving web 2 while the outlet portion of the slot of the application head 16 is pushed toward the surface of the web, so that a layer 10 of the applied liquid is formed on the web.

Since the intermediate part of the outlet section of the back edge portion 4 of the application head 16 has grooves 17 adjacent to the surfaces 7 and wall surfaces 15 at the end parts, the gap between the intermediate part of the outlet section and the web at the groove 17 is larger than the gap between the web 2 and the surfaces 7 of the end parts of the outlet section of the back edge portion. As a result, when the solvent 14 is pushed and spread by the surfaces 7 of the end parts of the outlet section of the back edge portion 4 of the head 16, it is less likely to spread inward from the wall surfaces 15 in the direction of the width of the web 2 (i.e., into the liquid-applied portion). The solvent 14 can thus be applied in advance to the liquid-free side edge portions of the web 2 and it will not spread to the liquid-applied portion of the web or flow around to the opposite surface thereof. Moreover, the solvent applied to the liquid-free side edge portions near the layer 10 of the applied liquid is prevented from coming into contact with the back edge portion 4 and doctor edge portion 5 of the application head 16. Thus, the thickness of the layer 10 of the liquid applied to the web 2 is uniform. The provision of the grooves 17, shown in FIG. 3, may also be employed in the first embodiment of the invention described above.

It is preferable that the depth (which has a rectangular cross-section and which is equal to the height of each of the wall surfaces 15) of each of the notch 8 and grooves 17 be approximately 5 to 200 μm. The cross section of each of the notch 8 and grooves 17 may be shaped in other various forms such as a "V" or a semicircle, so long as the notches and the grooves are formed in such a manner that the surfaces of both the end parts of the outlet section of the back edge portion 4 of the application head 16 are located closer to the surface of the web than the surface of at least the area of the intermediate part (which corresponds to the liquid-applied portion of the web) of the outlet section of the back edge portion 4, which is adjacent to the end parts of the outlet section.

The application devices described herein are not confined to the extrusion type, but may also be of other types as long as a liquid is applied to the surface of a continuously moving flexible carrier while the outlet portion of the slot of the application head of the device is pushed toward the surface of the carrier.

The application device provided in accordance with the present invention applies a liquid to the surface of a continuously moving band-like flexible carrier, while the outlet portion of the slot of an application head is pushed toward the surface of the carrier. The surfaces of the end parts of the outlet section of the back edge portion of the head (which correspond to the liquid-free side edge portions of the carrier) are located closer to the surface of the carrier than the surface of at least the area of the intermediate part (which corresponds to the liquid-applied portion of the carrier) of the outlet section of the back edge portion, which is adjacent to the end parts of the outlet section of the back edge portion. As a result, solvent can be applied to the liquid-free side edge portions of the carrier outside the liquid-applied portion immediately before the application of the liquid to the carrier in such a manner that it does not spread to the liquid-applied portion of the carrier and/or flow around to the opposite surface. Moreover, the solvent applied to the liquid-free side edge portions of the carrier is prevented from coming into contact with the outlet portion of the application head located at the slot. For this reason, even if the thickness of the carrier is small, the liquid-free side edge portions of the carrier are prevented from being scraped near the liquid-applied portion by the outlet portion of the head, and no foreign matter clinging to the surface of the carrier is caught on the end parts of the application head. Therefore, foreign matter is prevented from accumulating on each end part of the application head and from pushing up the side edge portions of the carrier, thus making the thickness of the layer of the liquid applied to the carrier uniform. Finally, the liquid applied to the carrier by the device does not flow out of the liquid-applied areas, the thickness of the layer of the applied liquid on the carrier is uniform, and the surface of the layer is satisfactory.

The effects of the present invention are hereafter clarified with reference to an Actual Example of the above embodiment.

An application device constructed as shown in FIG. 1 was used to apply a magnetic liquid to a polyethylene terephthalate carrier of 10 μm in thickness and 500 mm in width. The quantity of the applied liquid, the speed of application, the tension of the carrier at the place of the application, and the width of the layer of the applied liquid on the carrier were 17 cc/m$^2$, 250 m/min, 20 kg/m, and 485 mm, respectively.

To produce the magnetic liquid, substances shown in Table 1 were mixed and dispersed in a ball mill for 10.5 hours. When the viscosity of the magnetic liquid was measured with a viscometer of the ring cone type, the reading thereof was 1.9 poise at a shearing speed of 700 per sec. A magnetic recording medium of 8,000 mm in length was manufactured. During the application process, it was observed whether the liquid-free side edge portions of the carrier near the layer of the applied liquid thereon were scraped and whether the solvent on the liquid-free side edge portions entered the layer of the applied liquid on the carrier. The ratio of the thickness of each side edge portion of the layer of the applied liquid to the mean thickness of the overall layer was also measured. Table 2 shows the results of these observations and measurements. The height of each wall surface 15 of the application head was 50 μm. The solvent, which was applied to the liquid-free side edge portions of the carrier in advance, was methyl isobutyl ketone.

TABLE 1

| | |
|---|---|
| $\gamma$-$Fe_2O_3$ (0.6 μm in mean diameter of grains along major axis thereof and 320 Oe in Hc) | 300 parts by weight |
| Copolymer of vinyl chloride an vinyl acetate (87:13 in polymerization ratio and 450 in polymerization degree) | 40 parts by weight |
| Electroconductive carbon | 20 parts by weight |
| Stearic acid | 7 parts by weight |
| Silicone oil | 3 parts by weight |
| Xylol as solvent | 300 parts by weight |
| Methyl isobutyl ketone as solvent | 400 parts by weight |

A method as disclosed in Japanese Unexamined Patent Application 257268/86, and a device as disclosed in Japanese Unexamined Patent Application No. 52069/90, including an extrusion-type application head having wall surfaces of 50 μm in height at the ends of the head, were separately used to apply the same magnetic liquid to the same carrier having the same values as the above-described Actual Example. The same observations and measurements were performed on the media as in the Actual Example. Table 2 shows a comparison of the results of the observations and measurements of the Actual Example and Comparative Examples 1 and 2.

TABLE 2

| Sample | Scraping | Ratio of Thickness | Entry of solvent into liquid layer |
|---|---|---|---|
| Actual Example | | 0 | Did not enter |
| Comparative Example 1 | | 0 | Entered |
| Comparative Example 2 | X | 12 | — |

Notes:
The surface of the medium was satisfactory because it was not scratched or scraped.
X: The surface of the medium was not satisfactory because of scratches creating scraped chips.

The results, as shown in Table 2, from the Actual Example are significantly better than those obtained with Comparative Examples 1 and 2, which correspond to the conventional application method and device.

What is claimed is:

1. In an extrusion-type application device having an application head comprising a doctor edge portion and a back edge portion between which is defined a slot from which liquid is applied to a central portion of a continuously moving flexible band-like carrier to which a solvent has been applied in advance to side edge portions of said carrier, the improvement comprising:

said application head including an outlet section of the back edge portion comprising two end portions having an intermediate portion disposed therebetween, at least a portion of a top surface of said intermediate portion inwardly from and adjacent to said end portions horizontally lying below a top surface of each of said end portions, wherein, as said carrier passes over said outlet section, a gap between said side edge portions of said carrier and said top surface of each of said end portions is less than a gap between said central portion of said carrier and said top surface of said at least a portion of said intermediate portion adjacent to each of said end portions, and first and second wall surfaces vertically extending up from said at least a portion of said top surface of said intermediate portion to respectively couple surfaces of said end portions so that said solvent applied to said side edge portions of said carrier is prevented from spreading inwardly from side edge portions to said central portion of said carrier as said carrier moves past said application head.

2. The application device as claimed in claim 1, wherein said intermediate portion has formed therein a notch between and adjacent to said wall surfaces and said surfaces of said end portions an extending in the direction of movement of said carrier.

3. The application device as claimed in claim 1, wherein said intermediate portion has formed therein grooves adjacent said wall surfaces and said surfaces of said end portions and extending in the direction of movement of said carrier.

4. The application device as claimed in claim 1, wherein each of said wall surfaces have a height being in a range of approximately 5 to 200 μm.

5. The application device as claimed in claim 1, further comprising a pair of restriction plates fitted in said slot for setting the width of said central portion of said carrier and thereby establishing the width of said liquid applied to said carrier.

6. An application head for an extrusion-type application device adapted for use with a continuously moving flexible band-like carrier, comprising:

a doctor edge portion;

a back edge portion, a slot being defined between said doctor edge portion and said back edge portion from which liquid is applied to a central portion of a carrier, said carrier having side edge portions to which solvent has been applied in advance, and said back edge portion including an outlet section, wherein said outlet section comprises two end portions having an intermediate portion disposed therebetween, a part of said intermediate portion inwardly from and adjacent to said end portions horizontally lying below a top surface of each of said end portions, and wherein, as said carrier passes over said outlet portion, a gap between said side edge portions of said carrier and sad top surface of each of said end portions is less than a gap between said central portion of said carrier and sad top surface of said part of said intermediate portion adjacent to each of said end portions, and first and second wall surfaces vertically extending up from said at least a portion of said top surface of said intermediate portion to respectively couple surfaces of said end portions so that said solvent applied to said side edge portions of said carrier is prevented from spreading inwardly from said side edge portions to said central portion of said carrier as said carrier moves past said application head, wherein said intermediate portion has grooves formed therein adjacent said wall surfaces and said surfaces of said end portions, said grooves extending in the direction of movement of said carrier.

* * * * *